US005178930A

United States Patent [19]

Sakai et al.

[11] Patent Number: 5,178,930

[45] Date of Patent: Jan. 12, 1993

[54] THERMAL TRANSFER RECORDING MEDIUM

[75] Inventors: Kouichi Sakai; Sadashi Ueda; Keizou Takahashi; Hiroshi Shibano, all of Tochigi, Japan

[73] Assignee: Kao Corporation, Tokyo, Japan

[21] Appl. No.: 658,291

[22] Filed: Feb. 20, 1991

[30] Foreign Application Priority Data

Feb. 28, 1990 [JP] Japan ..... 2-48392
Feb. 28, 1990 [JP] Japan ..... 2-48393

[51] Int. Cl.[5] ..... B41M 5/38

[52] U.S. Cl. ..... 428/195; 428/484; 428/488.1; 428/488.4; 428/913; 428/914; 428/413; 428/423.1

[58] Field of Search ..... 428/195, 484, 488.1, 428/488.4, 913, 914, 413, 423.1

[56] References Cited

U.S. PATENT DOCUMENTS

| | | | |
|---|---|---|---|
| 4,251,276 | 2/1981 | Ferree, Jr. et al. | 400/241 |
| 4,308,318 | 12/1981 | Weiche | 428/412 |
| 4,707,406 | 11/1987 | Inaba et al. | 428/336 |
| 4,880,324 | 11/1989 | Sato et al. | 428/484 |
| 4,882,218 | 11/1989 | Koshizuka et al. | 428/216 |

FOREIGN PATENT DOCUMENTS

| | | |
|---|---|---|
| 0350889 | 1/1990 | European Pat. Off. . |
| 3317755 | 11/1983 | Fed. Rep. of Germany . |
| 3631781 | 3/1987 | Fed. Rep. of Germany . |
| 54-87234 | 7/1979 | Japan . |
| 54-163014 | 12/1979 | Japan . |
| 56-98269 | 8/1981 | Japan . |
| 61-206697 | 9/1986 | Japan . |
| 62-130887 | 6/1987 | Japan . |

OTHER PUBLICATIONS

European Search Report.

*Primary Examiner*—Patrick J. Ryan
*Assistant Examiner*—T. A. Powers
*Attorney, Agent, or Firm*—Birch, Stewart, Kolasch & Birch

[57] ABSTRACT

A thermal transfer recording medium comprising a support and a heat-fusible ink layer, coated on the support, which comprises a colorant and a binder. The binder comprises a polyurethane having bisphenol units or a polyether having bisphenol units and an hydroxyl group at the terminals. The thermal transfer recording medium provides a transferred image with a high quality regardless of the transferring paper.

11 Claims, No Drawings

THERMAL TRANSFER RECORDING MEDIUM

BACKGROUND OF THE INVENTION

1. Field of the Invention

The present invention relates to a thermal transfer recording medium usable in a thermal transfer recording apparatus such as a printer or a facsimile. In particular, the present invention relates to a thermal transfer recording medium usable for forming a transfer record of high quality without being influenced by the surface conditions of the paper to which the image is to be transferred.

2. Description of the Related Arts

A thermal transfer recording system comprises placing a thermal transfer recording medium comprising a support, in sheet form, coated with at least one heat-fusible ink layer onto a paper to which the image is to be transferred in such a manner that the heat-fusible ink layer is brought into contact with the paper. The ink layer is then melted by heating the support side of the recording medium with a heating head to transfer the image to the paper. This method has become widely used, since the operability maintenance of the apparatus are excellent, its noise is low and the image can be transferred to plain paper.

However, the above-described heat-fusible ink used heretofore has a problem in that the binder thereof mainly comprises a was. Since the softening of the wax causes the fused ink to be transferred to the surface of a paper, the transferred image is influenced by the surface conditions of the paper. In particular, the viscosity of the wax is seriously reduced by heat and its fused viscosity is very low, so that when the surface of the paper to which the image is to be transferred is uneven, the area of contact of the ink with the recessed part is only small. For example, when the Bekk smoothness of the paper surface is 30 to 40 sec or less, the ink cannot be uniformly spread over the paper which impairs the quality of the image.

When the thickness of the ink is increased to increase the quantity of the ink placed on a particular point of the paper, the ink covers the surface of the paper without fail to solve the problem of an insufficient density of the image or blur due to incomplete transfer of the ink. However, on the other hand, blotting is accelerated to increase the dot size, thereby impairing the resolution and reducing the quality of the image.

Although, the use of a resin as a binder for the heat-fusible inks is known from Japanese Patent Laid-Open Nos. 87234/1979, 163014/1979, 98269/1981 and 130887/1987, its performance is yet unsatisfactory.

SUMMARY OF THE INVENTION

Therefore, an object of the present invention is to provide a thermal transfer recording medium capable of transferring an image of a high quality substantially without being influenced by the surface conditions of the paper to which the image is to be transferred. Another object of the present invention is to provide a thermal transfer recording medium having a high resolution.

After intensive investigations, the inventors have found that the above-described objects can be attained by replacing the wax ordinarily used as the main component of the binder of a heat-fusible ink with a polyurethane resin having a bisphenol skeleton or a polyether resin having a bisphenol skeleton and being terminated with a hydroxyl group and that the sensitivity can be further improved to form a transferred image of a high quality by forming a release layer between the support and a heat-fusible ink layer comprising the polyurethan or the polyether as a binder. This is the invention which has been completed on the basis of these findings.

The thermal transfer recording medium of the invention comprises a support and a heat-fusible ink layer, coated on the support, comprising a colorant and a binder comprising a polyurethane having bisphenol units or a polyether having bisphenol units and hydroxy at the terminals. It provides a transferred image with a high quality, not depending on the transferring paper.

The thermal transfer recording medium includes two embodiments. In one embodiment the binder comprises a polyurethane having bisphenol units. In the other the binder comprises a polyether having bisphenol units and hydroxy at the terminals.

It is preferable that the polyurethane and the polyether each have a number-average molecular weight, determined by gel permeation chromatography, of not higher than 20,000 and a glass transition point, determined to the differential thermobalance method, of at least 40 degree C.

The polyurethane can be obtained from a bisphenol or its adduct of propylene oxide or ethylene oxide and an isocyanate compound having at least two isocyanate groups. The polyether is obtained from a bisphenol or its adduct of propylene oxide or ethylene oxide and an epoxy compound having at least two epoxy groups. The binder may further comprise another polymer.

The medium may further comprise a release layer between the support and the ink layer.

The waxes used heretofore as the binder for the heat-fusible ink include paraffin wax, carnauba wax, montan wax, beeswax, haze wax, candelilla wax, low-molecular polyethylene, α-olefin oligomers and modified products of them. The wax is mixed, if necessary, with a mineral oil such as a spindle oil, a vegetable oil such as linseed oil or tung oil, plasticizer such as dioctyl phthalate or dibutyl phthalate, a higher fatty acid such as oleic acid or stearic acid or its metal salt, amide or another derivative together with a dye, pigment or the like to form a mixture or dispersion, which is applied to a thin plastic film or a capacitor paper to form a thermal transfer recording medium.

The waxes used heretofore as the binder are crystalline and, therefore, they have a relating well-defined melting point in the temperature range of about 50° to 150° C. When they are heated to a temperature above the melting point, they are rapidly changed from the solid phase into the liquid phase. At a temperature higher than the melting point by about 30° C., they are in liquid form having a viscosity of as low as about $10^2$ to 10 P.

On the contrary, most resins essentially have no melting point and they are gradually changed from the solid phase into the liquid phase as the temperature is elevated over the glass transition point (Tg). During this period, the viscosity is usually reduced only slightly and it is hot lower than about $10^3$ to $10^5$ P even at a temperature higher than Tg by about 50° C. Since the transfer and fixing sensitivities in the thermal transfer recording basically depend on the fused viscosity and fused viscoelasticity of the binder, it is undoubtedly disadvantageous from the viewpoint of the sensitivity to use a resin as the binder of the heat-fusible ink. The inventors have found, however, that when one of the two specified binder resin is used, a transfer record having a high quality can be obtained without being influenced by the surface conditions of the paper to which the image is to be transferred and without reducing the sensitivity and that a high resolution can be obtained. The thermal transfer recording medium of the present invention will now be described in detail.

The support of the thermal transfer recording medium of the present invention may be a thin sheet or film of a paper such as capacitor paper or glassine paper or a plastic such as polyester, polyimide, polycarbonate, polyamide, polyethylene or polypropylene. The thickness of the support is preferably in the range of about 2 to 20 μm. When a thermal head is used for the recording, a layer of a silicone, fluorine compound, resin, crosslinked polymer or metal can be formed on the side of the support to be brought into contact with the head in order to improve the heat resistance and travelling performance.

The polyurethane and the polyether of the thermal transfer recording medium of the present invention has a number-average molecular weight determined by gel permeation chromatography (GPC) of not higher than about 20,000 and a glass transition point (Tg) determined by the differential thermobalance (DSC) method of at least about 40° C., preferably a number-average molecular weight of not higher than about 10,000 and Tg in the range of about 55° to 90° C. When the Tg is lower than 55° C., particularly lower than 40° C., the blocking of the heat-fusible ink is apt to occur and its stability is insufficient during the storage or at the time of use. When the Tg is above 90° C., the thermal stability is excellent but it is not practically effective because of the lowering of the sensitivity and, therefore, its use is limited.

It was found experimentally that even if the Tg of the binder resin is in the above-described range, the sensitivity is unsatisfactory when the molecular weight of the polyurethane resin is high. Supposedly it is caused by an intermolecular cohesive force generated by the interlocking of the molecular chains, etc. Excellent transfer and fixing were possible when the number-average molecular weight was not higher than about 20,000, particularly not higher than 10,000. It was also found that the surface conditions of the paper to which the image is to be transferred exert no influence. The weight-average molecular weight is variable depending on the use of the thermal transfer recording medium. When a two-valued transferred image is to be formed, the weight-average molecular weight is adjusted to about 20,000 or less, preferably about 10,000 or less like in the conventional wax-containing ink. It is desirable that by thus limiting the molecular weight distribution in a narrow range, the softening properties of the resin are made sharper. When a density gradation or multi-valued transferred image is desired or it is to be used repeatedly many times, it is preferred to melt a resin having mild softening properties according to the applied energy to conduct the transfer. It is not always necessary for this purpose to employ the resin of a low weight-average molecular weight and the weight-average molecular weight may be higher than about 20,000. Also in this case, an excellent two-valued transferred image can be obtained as a matter of course. As for the pattern of the molecular weight distribution, a single molecular weight peak is not always necessary but two or more molecular weight peaks may be formed. A combination of a crosslinked polymer with a branched polymer may be used. A weight-average molecular weight of 10,000 or higher, particularly 40,000 or higher, is disadvantageous from the viewpoint of the sensitivity.

The polyurethane of the invention includes those produced by the addition polymerization of a diol such as a bisphenol compound of the following formula:

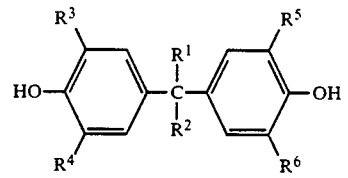

1)

wherein $R^1$ and $R^2$ each represent a hydrogen atom, alkyl group or phenyl group, and $R^3$, $R^4$, $R^5$ and $R^6$ each represent a hydrogen atom, alkyl group or halogen group,

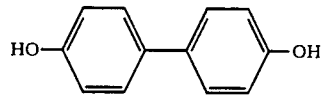

2)

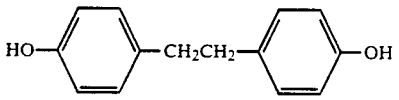

3)

or

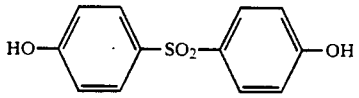

4)

or a propylene oxide adduct or ethylene oxide adduct thereof with an aliphatic isocyanate compound, alicyclic isocyanate compound or aromatic isocyanate compound having two isocyanato groups in the molecule, such as toluene diisocyanate (TDI), 4,4'-diphenylmethane diisocyanate (MDI) or hexamethylene diisocyanate. Further, the polyurethane resin may be a branched or crosslinked one produced by using an isocyanate compound having three or more isocyanate groups in the molecule.

The polyether can be produced, in a similar way to the polyurethane, by addition-polymerizing a diol such as a bisphenol above shown or a propylene oxide adduct or ethylene oxide adduct thereof with an aliphatic epoxy compound, alicyclic epoxy compound or aromatic epoxy compound having two epoxy groups in the molecule in such a manner that the reaction product will not be terminated with an epoxy group or those produced by the addition polymerization of a bisphenol epoxy resin with a compound having two hydroxyl groups, a combination of a hydroxyl group and an amino group or a combination of a hydroxyl group and a carbonyl group in such a manner that the reaction product will not be terminated with an epoxy group. Further the polyether resin may be a branched or crosslinked one produced by using an epoxy compound having three or more epoxy groups in the molecule. As a matter of course, the polyether resins usable in the present invention are not limited to those produced by these processes.

In addition to the polyurethane and the polyether above defined, the binder may further comprise another polymer and an additive if necessary.

The binder may include both polyurethane and polyether defined above to this effect. It may include another type of polyurethane or polyether.

The polymer which can be incorporated into the binder includes homopolymers and copolymers of styrene and its derivatives and substituted styrenes, such as styrene, vinyltoluene, α-methylstyrene, 2-methylstyrene, chlorostyrene, vinylbenzoic acid, sodium vinylbenzenesulfonate and aminostyrene; homopolymers of methacrylates such as methyl methacrylate, ethyl methacrylate, butyl methacrylate and hydroxyethyl methacrylate; methacrylic acid; acrylates such as methyl acrylate, ethyl acrylate, butyl acrylate and 2-ethylhexyl acrylate; acrylic acid; dienes such as butadiene and isoprene; acrylonitrile; and vinyl monomers such as vinyl ethers, maleic acid, maleic esters, maleic anhydride, cinnamic acid and vinyl chloride; and copolymers of them with other monomers. As a matter of course, the vinyl resin may be used in the form of a crosslinked polymer formed by using a polyfunctional monomer such as divinylbenzene. In addition, polycarbonates, polyamides, polyesters, silicone resins, fluororesins, epoxy resins, phenolic resins, terpene resins, petroleum resins, hydrogenated petroleum resins, alkyd resins, ketone resins and cellulose derivatives may be used. When the polymer or oligomer is used in the copolymer form, the copolymer may be a random copolymer or it may be suitably selected from the group consisting of alternating copolymers, graft copolymers, block copolymers and interpenetrating copolymers. When two or more polymers or oligomers are used in mixture, they may be mixed together by mechanical mixing means such as melt mixing, solution mixing or emulsion mixing or they can be mixed together while forming the polymer or oligomer by coexistence polymerization or multistage polymerization.

If necessary, wax, oil, liquid plasticizer, etc., incorporated into ordinary heat-fusible inks may be incorporated into the ink of the present invention. To obtain an image of a high quality, the amount of the binder resin is preferably at least 30% by volume, still preferably at least 70% by volume, based on the total binder components.

The colorants usable herein include black dyes and pigments such as carbon black, oil black and graphite; acetoacetic arylamide monoazo yellow pigments (Fast Yellow) such as C.I. Pigment Yellow 1, 3, 74, 97 and 98; acetoacetic arylamide bisazo yellow pigments such as C.I. Pigment Yellow 12, 13 and 14; yellow dyes such as C.I. Solvent Yellow 19, 77, 79 and C.I. Disperse Yellow 164; red or crimson pigments such as C.I. Pigment Red 48, 49:1, 53;1, 57:1, 81, 122 and 5; red dyes such as C.I. Solvent Red 52, 58 and 8; and blue dyes and pigments such as copper phthalocyanines, e.g. C.I. Pigment Blue 15:3, and derivatives and modified products thereof. In addition, other known dyes and pigments used for coloring or as a material for printing inks, such as colored or colorless subliming dyes, are also usable.

These dyes and pigments may be used either singly or in the form of a mixture of two or more of them. As a matter of course, they may be mixed with an extender pigment or white pigment to adjust the color tone. To improve the dispersibility in the binder, the surface of the colorant particle may be treated with a coupling agent such as a silane coupling agent or with a polymeric material or, alternatively, a polymeric dye or polymer-grafted pigment may be used.

The thermal transfer recording medium of the present invention is produced by applying a heat-fusible ink comprising a mixture of the above-described binder resin, colorant and, if necessary, the above-described additives to the support. The sensitivity of the thermal transfer recording medium can be further improved by forming a release layer between the support and the heat-fusible ink layer.

The release layer comprises a silicone resin, higher fatty acid, metal salt of a higher fatty acid, fatty acid derivative, higher alcohol or wax. Among then, wax is particularly preferred. The waxes usable herein include known waxes used heretofore as a binder of heat-fusible inks such as paraffin wax, montan wax, carnauba wax, beeswax, haze wax, and candelilla wax as well as low-molecular polyethylene, α-polyolefin oligomers and modified products of them. These waxes may be used either alone or in the form of a mixture of two or more of them. In addition, a resin such as ethylene/vinyl acetate copolymer, ethylene/acrylic acid copolymer, polyethylene or petroleum resin may be added thereto in order to improve the coating film strength.

The heat-fusible ink of the present invention can be produced by dissolving or dispersing a binder in a solvent or dispersion medium in which the binder is soluble or stably dispersible to form a solution or emulsion with a mixer or dispersing device such as a ball mill, sand mill, attritor, basket mill or three-roll mill. Further, the ink can be produced also by melt-mixing them without using any solvent or the like with a heating three-roll mill, heating kneader, heating sand mill or heating attritor. In addition, the binder resin as the main binder material can be synthesized in the presence of the colorant, additive, etc., to form a heat-fusible ink.

The heat-fusible ink thus produced is applyed to a support with a gravure coater, wire bar or the like by solution or melt coating to form a thermal transfer recording medium to be used for printing.

The heat-fusible ink may be pulverized by spray drying, pulverization or the like method and the formed powder is applied to the support by electrostatic coating. If necessary, the powder coating may be followed by heating, compression or treatment with a solvent to fix the heat-fusible ink on the support.

Thus the present invention provides a thermal transfer recording medium capable of forming a transferred image of a high quality without being influenced by the surface unevenness of the paper to which the image is to be transferred. Further, by forming a release layer mainly comprising a wax between the support and the heat-fusible ink layer of the thermal transfer recording medium of the present invention, the sensitivity of the medium is further improved.

EXAMPLES

The following Examples will further illustrate the present invention, which by no means limit the invention.

In the following Examples, parts are given by weight unless otherwise stated.

EXAMPLE 1

Synthesis of Polyurethane Resin A 350 g of G 1652 [propylene oxide (2 mole) adduct of bisphenol A; a product of Kao Corp.] was placed in a 1-l separable flask and kept at 110° C. by heating. 170 g of MDI ( a product of Nippon Polyurethane Co., Ltd.) was added thereto in portions to form Polyurethane resin A.

Production of Heat-fusible Ink

The following heat-fusible ink components were kneaded together in a ball mill at ambient temperature for 24 h to obtain a heat-fusible ink:

| | |
|---|---|
| Polyurethane resin A | 14 parts |
| [ number-average molecular weight ($\overline{M}n$) = 2000<br>weight-average molecular weight ($\overline{M}w$) = 4500<br>glass transition temperature (Tg) = 70° C. ] | |
| ethylene/vinyl acetate copolymer | 2 parts |
| carbon black | 4 parts |
| toluene | 40 parts |
| methyl ethyl ketone | 40 parts |

The heat-fusible ink produced as described above was applied to a polyimide film having a thickness of 4 μm with a wire bar and then dried at 60° C. to form a heat-fusible ink layer having a thickness of 2.5 μm.

EXAMPLE 2

The following heat-fusible ink components were kneaded together in a ball mill at ambient temperature for 24 h to obtain a heat-fusible ink:

| | |
|---|---|
| Polyurethane resin B | 12 parts |
| [ reaction product of G 1672 [ethylene oxide (2 mol) adduct of bisphenol A; a product of Kao Corp.] with TDI<br>number-average molecular weight ($\overline{M}n$) = 3000<br>weight-average molecular weight ($\overline{M}w$) = 7000<br>glass transition temperature (Tg) = 75° C. ] | |
| ethylene/vinyl acetate copolymer | 3 parts |
| carbon black | 5 parts |
| toluene | 40 parts |
| methyl ethyl ketone | 40 parts |

The heat-fusible ink produced as described above was applied to a polyester film having a thickness of 4 μm with a wire bar and then dried at 60° C. to form a heat-fusible ink layer having a thickness of 2.5 μm.

EXAMPLE 3

The following heat-fusible ink components were kneaded together in a ball mill at ambient temperature for 24 h to obtain a heat-fusible ink:

| | |
|---|---|
| Polyurethane resin B | 13 parts |
| [ reaction product of G 1672 [ethylene oxide (2 mol) adduct of bisphenol A; a product of Kao Corp.] with TDI<br>number-average molecular weight ($\overline{M}n$) = 8000<br>weight-average molecular weight ($\overline{M}w$) = 13000<br>glass transition temperature (Tg) = 88° C. ] | |
| ethylene/vinyl acetate copolymer | 3 parts |
| carbon black | 4 parts |
| toluene | 40 parts |
| methyl ethyl ketone | 40 parts |

The heat-fusible ink produced as described above was a plied to a polyester film having a thickness of 4 μm with a wire bar and then dried at 60° C. to form a heat-fusable ink layer having a thickness of 2.5 μm.

EXAMPLE 4

The following layers were formed on a polyester film having a thickness of 6 μm to form an ink sheet to be used as the thermal transfer recording medium:

(1) Release layer:

Microcrystalline wax having a melting point of 75° C. was applied to the film with a wire bar in a thermostatic bath at 100° C. to form a release layer having a thickness of 1.5 μm.

(2) Heat-fusible ink layer:

The heat-fusible ink prepared in Example 1 was applied to the release layer with a wire bar to form a heat-fusible ink layer having a thickness of 3 μm, thereby forming a thermal transfer ink sheet.

EXAMPLE 5

The following layers were formed on a polyester film having a thickness of 4 μm to form an ink sheet to be used as the thermal transfer recording medium:

(1) Release layer:

Oxidized paraffin wax having a melting point of 85° C. was applied to the film with a wire bar in a thermostatic bath at 100° C. to form a release layer having a thickness of 1.5 μm.

(2) Heat-fusible ink layer:

The heat-fusible ink prepared in Example 2 was applied to the release layer with a wire bar to form a heat-fusible ink layer having a thickness of 3 μm, thereby forming a thermal transfer ink sheet.

EXAMPLE 6

The following layers were formed on a polyester film having a thickness of 4 μm to form an ink sheet to be used as the thermal transfer recording medium:

(1) Release layer:

Carnauba wax having a melting point of 82° C. was applied to the film with a wire bar in a thermostatic bath at 100° C. to form a release layer having a thickness of 1.5 μm.

(2) Heat-fusible ink layer:

The heat-fusible ink prepared in Example 3 was applied to the release layer with a wire bar to form a heat-fusible ink layer having a thickness of 3 μm, thereby forming a thermal transfer ink sheet.

COMPARATIVE EXAMPLE 1

The following heat-fusible ink components were melt-mixed at 100° C. and then kneaded with a three-roll mill to obtain a heat-fusible ink:

| | |
|---|---|
| paraffin wax (melting point: 72° C.) | 50 parts |
| carnauba wax | 20 parts |
| ethylene/vinyl acetate copolymer | 10 parts |
| carbon black | 20 parts |

The heat-fusible ink produced as described above was applied to a polyester film having a thickness of 4 μm placed on a hot plate heated at 110° C. with a wire bar to form a heat-fusible ink layer having a thickness of 3 μm, thereby forming a thermal transfer ink sheet.

COMPARATIVE EXAMPLE 2

The following heat-fusible ink components were kneaded together in a ball mill at ambient temperature for 24 h to obtain a heat-fusible ink:

| | |
|---|---|
| unsaturated polyester resin | 12 parts |
| [ number-average molecular weight ($\overline{Mn}$) = 2500<br>weight-average molecular weight ($\overline{Mw}$) = 7000<br>glass transition temperature (Tg) = 70° C. ] | |
| ethylene/vinyl acetate copolymer | 3 parts |
| carbon black | 5 parts |
| toluene | 40 parts |
| methyl ethyl ketone | 40 parts |

The heat-fusible ink produced as described above was applied to a polyester film having a thickness of 4 μm with a wire bar and then dried at 60° C. to form a heat-fusible ink layer having a thickness of 2.5 μm.

COMPARATIVE EXAMPLE 3

The following layers were formed on a polyester film having a thickness of 6 μm to form an ink sheet to be used as the thermal transfer recording medium.

(1) Release layer:

Microcrystalline wax having a melting point of 75° C. was applied to the film with a wire bar in a thermostatic bath at 100° C. to form a release layer having a thickness of 1.5 μm.

(2) Heat-fusible ink layer:

| | |
|---|---|
| paraffin wax (melting point: 72° C.) | 12 parts |
| carnauba wax | 2 parts |
| ethylene/vinyl acetate copolymer | 2 parts |
| carbon black | 4 parts |
| toluene | 40 parts |
| methyl ethyl ketone | 40 parts |

The above-described components were kneaded with a ball mill at 40° C. for 24 h to obtain a heat-fusible ink, which was applied to the release layer with a wire bar to form a heat-fusible ink layer having a thickness of 3 μm, thereby forming a thermal transfer ink sheet.

COMPARATIVE EXAMPLE 4

The following layers were formed on a polyester film having a thickness of 4 μm to form an ink sheet to be used as the thermal transfer recording medium.

(1) Release layer:

Carnauba wax having a melting point of 82° C. was applied to the film with a wire bar in a thermostatic bath at 100° C. to form a release layer having a thickness of 1.5 μm.

(2) Heat-fusible ink layer:

The heat-fusible ink prepared in Comparative Example 2 was applied to the release layer with a wire bar to form a heat-fusible ink layer having a thickness of 3 μm, thereby forming a thermal transfer ink sheet.

The ink sheets obtained in the above Examples 1 to 6 and Comparative Examples 1 to 4 were used for printing with a serial printer PC-PR 150 V (mfd. by NEC Corp.) to examine the printing density, recording sensitivity and resolution of the transferred image.

The results are given in Table 1.

TABLE 1

| | | Printing density: paper for thermal transfer | Printing density: bond paper | Recording sensitivity | Resolution of transferred image |
|---|---|---|---|---|---|
| Comp. Ex. | 1 | 1.35 | 0.85 | Δ | x |
| | 2 | 1.14 | 0.88 | x | x |
| | 3 | 1.43 | 0.92 | Δ | x |
| | 4 | 1.21 | 0.97 | Δ | Δ |
| Ex. | 1 | 1.61 | 1.35 | ○ | ○ |
| | 2 | 1.63 | 1.38 | ○ | ○ |
| | 3 | 1.55 | 1.28 | ○ | ○ |
| | 4 | 1.63 | 1.44 | ○ | ○ |
| | 5 | 1.67 | 1.48 | ○ | ○ |
| | 6 | 1.60 | 1.35 | ○ | ○ |

The recording characteristic given in Table 1 were evaluated by the following methods:

Printing density:

The density of the print obtained by the serial printing was determined with a Macbeth densitometer.

As for the surface conditions of the paper, the Bekk smoothness of the paper to which the image was to be transferred was 200 sec and that of the bond paper was 15 sec.

Recording sensitivity:

The recording sensitivity was evaluated in terms of energy (E) applied to a thermal head necessary for recording a transfer dot corresponding to a thermal head heating element size of 1/12 mm (=83 μm) on the thermal transfer paper with a printing density of 1.2.

Criteria:

○: $E < 0.08$ mJ/dot

Δ: 0.08 mJ/dot $\leqq E \leqq$ 0.11 mJ/dot x: 0.11 mJ/dot $< E$ or printing density of less than 1.2

Resolution:

The resolution was evaluated in terms of easiness of making out "Kanji" characters formed particularly with many strokes.

Criteria:

○: easily readable

Δ: moderate x : difficult to read

The description will be made on the results of the evaluation of the heat-fusible inks listed in Table 1.

In Comparative Example 1 wherein wax was used as the binder, the printing density was low and some "Kanji" characters formed with many strokes were unclear and could not be easily read when the bond paper having an uneven surface was used, while relatively excellent printing results were obtained when a special paper for the thermal transfer was used. In Example 1, quite excellent printing results were obtained and a high printing density was obtained even when the bond paper was used.

In Comparative Examples 3 and 4, the effect of the release layer mainly comprising the wax which was formed between the support and the heat-fusible ink layer was exhibited. Although this effect (an improvement in the quality of the print) was superior to that obtained in Comparative Examples 1 and 2, it was yet inferior to that of the release layer-free heat-fusible ink sheet of Examples 1 to 3.

In also Examples 4 to 6, the effect of the release layer mainly comprising the wax which was formed between the support and the heat-fusible ink layer was obtained and the quality of the print was superior to that obtained in Examples 1 to 3.

EXAMPLE 7

Synthesis of Polyether Resin A 370 g of a bisphenolic epoxy resin "Epiclon" (a product of Dainippon Ink & Chemicals, Inc.) and 350 g of bisphenol A were placed in a 1-( separable flask and melted at 130° C. to obtain a homogeneous mixture. A catalyst was added thereto to form Polyether resin A having a hydroxyl group in the molecule.

Production of Heat-fusible Ink

The following heat-fusible ink components were kneaded together in a ball mill at ambient temperature for 24 h to obtain a heat-fusible ink:

| | |
|---|---|
| Polyether resin A<br>[ number-average molecular weight ($\overline{M}n$) = 2000<br>weight-average molecular weight ($\overline{M}w$) = 4000<br>glass transition temperature (Tg) = 65° C. ] | 12 parts |
| ethylene/vinyl acetate copolymer | 4 parts |
| carbon black | 4 parts |
| toluene | 40 parts |
| methyl ethyl ketone | 40 parts |

The heat-fusible ink produced as described above was applied to a polyimide film having a thickness of 4 μm with a wire bar and then dried at 60° C. to form a heat-fusible ink layer having a thickness of 2.5 μm.

EXAMPLE 8

The following heat-fusible ink components were kneaded together in a ball mill at ambient temperature for 24 h to obtain a heat-fusible ink:

| | |
|---|---|
| Polyether resin A<br>[ reaction product of Epikote 828<br>(a product of Yuka Shell Epoxy) with<br>bisphenol A<br>number-average molecular weight ($\overline{M}n$) = 8000<br>weight-average molecular weight ($\overline{M}w$) = 15000<br>glass transition temperature (Tg) = 83° C. ] | 14 parts |
| ethylene/vinyl acetate copolymer | 2 parts |
| carbon black | 4 parts |
| toluene | 40 parts |
| methyl ethyl ketone | 40 parts |

The heat-fusible ink produced as described above was applied to a polyimide film having a thickness of 4 μm with a wire bar and then dried at 60° C. to form a heat-fusible ink layer having a thickness of 2.5 μm.

EXAMPLE 9

The following heat-fusible ink components were kneaded together in a ball mill at ambient temperature for 24 h to obtain a heat-fusible ink:

| | |
|---|---|
| Polyether resin C<br>[ reaction product of Denacol<br>(a product of Nagase Industries, Co.)<br>with bisphenol A<br>number-average molecular weight ($\overline{M}n$) = 3000<br>weight-average molecular weight ($\overline{M}w$) = 7000<br>glass transition temperature (Tg) = 75° C. ] | 12 parts |
| ethylene/vinyl acetate copolymer | 2 parts |
| carbon black | 6 parts |
| toluene | 40 parts |
| methyl ethyl ketone | 40 parts |

The heat-fusible ink produced as described above was applied to a polyester film having a thickness of 4 μm with a wire bar and then dried at 60° C. to form a heat-fusible ink layer having a thickness of 2.5 μm.

EXAMPLE 10

The following heat-fusible ink components were kneaded together in a ball mill at ambient temperature for 24 h to obtain a heat-fusible ink:

| | |
|---|---|
| Polyether resin D<br>[ reaction product of Denacol<br>(a product of Nagase Industries, Co.)<br>with bisphenol A<br>number-average molecular weight ($\overline{M}n$) = 7000<br>weight-average molecular weight ($\overline{M}w$) = 13000<br>glass transition temperature (Tg) = 87° C. ] | 12 parts |
| ethylene/vinyl acetate copolymer | 3 parts |
| carbon black | 5 parts |
| toluene | 40 parts |
| methyl ethyl ketone | 40 parts |

The heat-fusible ink produced as described above was applied to a polyester film having a thickness of 4 μm with a wire bar and then dried at 60° C. to form a heat-fusible ink layer having a thickness of 2.5 μm

EXAMPLE 11

The following layers were formed on a polyester film having a thickness of 6 μm to form an ink sheet to be used as the thermal transfer recording medium:

(1) Release layer:

Microcrystalline wax having a melting point of 75° C. was applied to the film with a wire bar in a thermostatic bath at 100° C. to form a release layer having a thickness of 1.5 μm.

(2) Heat-fusible ink layer:

The heat-fusible ink prepared in Example 7 was applied to the release layer with a wire bar to form a heat-fusible ink layer having a thickness of 3 μm, thereby forming a thermal transfer ink sheet.

EXAMPLE 12

The following layers were formed on a polyester film having a thickness of 4 μm to form an ink sheet to be used as the thermal transfer recording medium:

(1) Release layer:

Carnauba wax having a melting point of 85° C. was applied to the film with a wire bar in a thermostatic bath at 100° C. to form a release layer having a thickness of 1.5 μm.

(2) Heat-fusible ink layer:

The heat-fusible ink prepared in Example 8 was applied to the release layer with a wire bar to form a heat-fusible ink layer having a thickness of 3 μm, thereby forming a thermal transfer ink sheet.

EXAMPLE 13

The following layers were formed on a polyester film having a thickness of 4 μm to form an ink sheet to be used as the thermal transfer recording medium:

(1) Release layer:

Oxidized paraffin wax having a melting point of 85° C. was applied to the film with a wire bar in a thermostatic bath at 100° C. to form a release layer having a thickness of 1.5 μm.

(2) Heat-fusible ink layer:

The heat-fusible ink prepared in Example 5 was applied to the release layer with a wire bar to form a heat-fusible ink lager having a thickness of 3 μm, thereby forming a thermal transfer ink sheet.

EXAMPLE 14

The following layers were formed on a polyester film having a thickness of 4 μm to form an ink sheet to be used as the thermal transfer recording medium:

(1) Release layer:

Paraffin wax having a melting point of 70° C. was applied to the film with a wire bar in a thermostatic bath at 100° C. to form a release layer having a thickness of 1.5 μm.

(2) Heat-fusible ink layer:

The heat-fusible ink prepared in Example 10was applied to the release layer with a wire bar to form a heat-fusible ink layer having a thickness of 3 μm, thereby forming a thermal transfer ink sheet.

COMPARATIVE EXAMPLE 5

The following heat-fusible ink components were melt-mixed at 100° C. and then kneaded with a three-roll mill to obtain a heat-fusible ink:

| | |
|---|---|
| paraffin wax (melting point: 72° C.) | 50 parts |
| carnauba wax | 20 parts |
| ethylene/vinyl acetate copolymer | 10 parts |
| carbon black | 20 parts |

The heat-fusible ink produced as described above was applied to a polyester film having a thickness of 4 μm placed on a hot plate heated at 110° C. with a wire bar to form a heat-fusible ink layer having a thickness of 3 μm, thereby forming a thermal transfer ink sheet.

COMPARATIVE EXAMPLE 6

The following heat-fusible ink components were kneaded together in a ball mill at ambient temperature for 24 h to obtain a heat-fusible ink:

| | |
|---|---|
| bisphenolic epoxy resin [Epikote 1004 having a melting point of 96 to 104° C. (a product of Shell Chem. Co.)] | 12 parts |
| ethylene/vinyl acetate copolymer | 4 parts |
| carbon black | 4 parts |
| toluene | 40 parts |
| methyl ethyl ketone | 40 parts |

The heat-fusible ink produced as described above was applied to a polyimide film having a thickness of 4 μm with a wire bar and then dried at 60° C. to form a heat-fusible ink layer having a thickness of 2.5 μm.

COMPARATIVE EXAMPLE 7

The following heat-fusible ink components were kneaded together in a ball mill at ambient temperature for 24 h to obtain a heat-fusible ink:

| | |
|---|---|
| unsaturated polyester resin [number-average molecular weight ($\overline{M}n$) = 2500; weight-average molecular weight ($\overline{M}w$) = 7000; glass transition temperature (Tg) = 70° C.] | 12 parts |
| ethylene/vinyl acetate copolymer | 2 parts |
| carbon black | 6 parts |
| toluene | 40 parts |
| methyl ethyl ketone | 40 parts |

The heat-fusible ink produced as described above was applied to a polyester film having a thickness of 4 μm with a wire bar and then dried at 60° C. to form a heat-fusible ink layer having a thickness of 2.5 μm.

COMPARATIVE EXAMPLE 8

The following layers were formed on a polyester film having a thickness of 6 μm to form an ink sheet to be used as the thermal transfer recording medium.

(1) Release layer:

Microcrystalline wax having a melting point of 75° C. was applied to the film with a wire bar in a thermostatic bath at 100° C. to form a release layer having a thickness of 1.5 μm.

(2) Heat-fusible ink layer:

| | |
|---|---|
| paraffin wax (melting point: 72° C.) | 12 parts |
| carnauba wax | 2 parts |
| ethylene/vinyl acetate copolymer | 3 parts |
| carbon black | 5 parts |
| toluene | 40 parts |
| methyl ethyl ketone | 40 parts |

The above-described components were kneaded with a ball mill at 40° C. for 24 h to obtain a heat-fusible ink, which was applied to the release layer with a wire bar to form a heat-fusible ink layer having a thickness of 3 μm, thereby forming a thermal transfer ink sheet.

COMPARATIVE EXAMPLE 9

The following layers were formed on a polyester film having a thickness of 4 μm to form an ink sheet to be used as the thermal transfer recording medium.

(1) Release layer:

Carnauba wax having a melting point of 82° C. was applied to the film with a wire bar in a thermostatic bath at 100° C. to form a release layer having a thickness of 1.5 μm.

(2) Heat-fusible ink layer:

The heat-fusible ink prepared in Comparative Example 2 was applied to the release layer with a wire bar to form a heat-fusible ink layer having a thickness of 3 μm, thereby forming a thermal transfer ink sheet.

COMPARATIVE EXAMPLE 10

The following layers were formed on a polyester film having a thickness of 4 μm to form an ink sheet to be used as the thermal transfer recording medium.

(1) Release layer:

Paraffin oxide wax having a melting point of 85° C. was applied to the film with a wire bar in a thermostatic bath at 100° C. to form a release layer having a thickness of 1.5 μm.

(2) Heat-fusible ink layer:

The heat-fusible ink prepared in Comparative Example 7 was applied to the release layer with a wire bar to form a heat-fusible ink layer having a thickness of 3 μm, thereby forming a thermal transfer ink sheet.

The ink sheets obtained in the above Examples 7 to 14 and Comparative Examples 5 to 10 were used for printing with a serial printer PC-PR 150 V (mfd. by NEC Corp.) to examine the printing density, recording sensitivity and resolution of the transferred image.

The results are given in Table 1.

TABLE 2

| | | Comparative Example | | | | | | Example | | | | | | | |
|---|---|---|---|---|---|---|---|---|---|---|---|---|---|---|---|
| | | 5 | 6 | 7 | 8 | 9 | 10 | 7 | 8 | 9 | 10 | 11 | 12 | 13 | 14 |
| Printing density | paper for thermal transfer | 1.35 | 1.48 | 1.14 | 1.43 | 1.52 | 1.21 | 1.62 | 1.55 | 1.60 | 1.53 | 1.65 | 1.62 | 1.63 | 1.60 |
| | bond paper | 0.85 | 1.28 | 0.88 | 0.92 | 1.34 | 0.97 | 1.37 | 1.33 | 1.35 | 1.34 | 1.44 | 1.40 | 1.44 | 1.39 |
| Recording sensitivity | | Δ | ○ | X | Δ | ○ | Δ | ○ | ○ | ○ | ○ | ○ | ○ | ○ | ○ |
| Resolution of transferred image | | X | X | X | X | X | Δ | ○ | ○ | ○ | ○ | ○ | ○ | ○ | ○ |
| Stability of ink sheet | | ○ | X | ○ | ○ | X | ○ | ○ | ○ | ○ | ○ | ○ | ○ | ○ | ○ |

The recording characteristics given in Table 2 were evaluated by the following methods:

Printing density:

The density of the print obtained by the serial printing was determined with a Macbeth densitometer.

As for the surface conditions of the paper, the Bekk smoothness of the paper to which the image was to be transferred was 200 sec and that of the bond paper was 15 sec.

Recording sensitivity:

The recording sensitivity was evaluated in terms of energy (E) applied to a thermal head necessary for recording a transfer dot corresponding to a thermal head heating element size of 1/12 mm=83 μm on the thermal transfer paper with a printing density of 1.2.

Criteria:

○: E <0.08 mJ/dot

Δ: 0.08 mJ/dot≦E≦0.11 mJ/dot x: 0.11 mJ/dot<E or printing density of less than 1.2

Resolution:

The resolution was evaluated in terms of easiness of making out "Kanji" characters formed particularly with many strokes.

Criteria:

○: easily readable,

Δ: moderate x: difficult to read

Stability of ink sheet:

After storage at a temperature of 45° C. and a humidity of 85% for 24 h, the printability of the sheet was evaluated and compared with that obtained before the environmental test.

The description will be made on the results of the evaluation of the heat-fusible inks listed in Table 2.

In Comparative Examples wherein wax was used as the binder, the printing density was low and some "Kanji" characters formed with many strokes were unclear and could not be easily read when the bond paper having an uneven surface was used, while relatively excellent printing results were obtained when a special paper for the thermal transfer was used. In Example 7, quite excellent printing results were obtained and a high printing density was obtained even when the bond paper was used.

In Comparative Example 6 wherein the epoxy resin was used as the binder, the storage stability of the ink sheet was unsatisfactory, since the resin binder had a reactive epoxy group, while a capacity close to that of the thermal transfer recording medium of the present invention could be obtained.

In Comparative Examples 8 to 10, the effect of the release layer mainly comprising the wax which was formed between the support and the heat-fusible ink layer was exhibited. Although this effect (an improvement in the quality of the print) was superior to that obtained in Comparative Examples 5 to 7, it was yet inferior to that of the ink sheet of Examples 7 to 10.

In also Examples 11 to 14, the effect of the release layer mainly comprising the wax which was formed between the support and the heat-fusible ink layer wag obtained and the quality of the print was superior to that obtained in Examples 7 to 10.

We claim:

1. A thermal transfer recording medium, comprising a support and a heat-fusible ink layer, which is coated on said support, comprising a colorant and a binder, said binder comprising a polyurethane having bisphenol units and a glass transition temperature, determined by the differential thermobalance method, of 40 to 90 degree C. or a polyether having bisphenol units and a hydroxyl group at the terminals and a glass transition temperature, determined by the differential thermobalance method, of 40 to 90 degree C., wherein at least 30% by volume of said binder consists of said polyrethane or said polyether.

2. The medium as claimed in claim 1 in which the binder comprises a polyurethane having bisphenol units.

3. The medium as claimed in claim 1 in which the binder comprises a polyether having bisphenol units and hydroxy at the terminals.

4. The medium as claimed in claim 1 in which said polyurethane or said polyether is selected from those having a number-average molecular weight, determined by gel permeation chromatography, of 2,000 to 20,000.

5. The medium as claimed in claim 1 in which the polyurethane is obtained from a bisphenol or its adduct of propylene oxide or ethylene oxide and an isocyanate compound having at least two isocyanate groups.

6. The medium as claimed in claim 1 in which the polyether is obtained from a bisphenol or its adduct of propylene oxide or ethylene oxide and an epoxy compound having at least two epoxy groups.

7. The medium as claimed in claim 1 in which the binder comprises said polyurethane or said polyether and another polymer.

8. The medium as claimed in claim 1, which further comprises a release layer between the support and the ink layer.

9. The medium as claimed in claim 1, wherein said polyurethane has a number-average molecular weight that is less than or equal to 10,000, as determined by gel permeation chromatography, and a glass transition temperature in the range of about 55° C. to 90° C., as determined by the differential thermobalance method.

10. The medium as claimed in claim 1, wherein said polyether has a number-everage molecular weight that is less than or equal to 10,000, as determined by gel permeation chromatography, and a glass transition temperature in the range of about 55° C. to 90° C., as determined by the differential thermobalance method.

11. A medium as claimed in claim 1, in which at least 70 % by volume of said binder consists of said polyurethane or said polyether.

* * * * *